United States Patent [19]

Svihra

[11] Patent Number: 4,719,832

[45] Date of Patent: Jan. 19, 1988

[54] COPPER FOIL CUTTER

[76] Inventor: Blazej Svihra, 463 Jefferson Ave., Rahway, N.J. 07065

[21] Appl. No.: 872,021

[22] Filed: Jun. 9, 1986

[51] Int. Cl.[4] ..... B26D 7/01; B65H 9/04

[52] U.S. Cl. ..... 83/407; 83/420; 83/447; 83/449; 83/649

[58] Field of Search ..... 83/444, 449, 450, 446, 83/447, 420, 448, 432, 434, 435, 407, 649, 650

[56] References Cited

U.S. PATENT DOCUMENTS

| | | | |
|---|---|---|---|
| 61,683 | 1/1867 | Pember . | |
| 345,873 | 7/1886 | Ames | 83/432 |
| 1,747,264 | 2/1930 | Rearick . | |
| 2,257,446 | 9/1941 | Amidon | 83/447 |
| 2,316,249 | 4/1943 | Johnson . | |
| 2,822,046 | 2/1958 | Krueger . | |
| 3,237,498 | 3/1966 | Hayman et al. | 83/649 |
| 3,492,899 | 2/1970 | Baldwin | 83/420 |
| 3,524,373 | 8/1970 | Helmus, Jr. et al. | 83/649 |
| 3,808,932 | 5/1974 | Russell | 83/860 |
| 4,018,119 | 4/1977 | Lennox | 83/425.3 |
| 4,147,082 | 4/1979 | Vecchi | 83/449 |
| 4,175,460 | 11/1979 | McPhail | 83/856 |

*Primary Examiner*—E. R. Kazenske
*Assistant Examiner*—Hien H. Phan
*Attorney, Agent, or Firm*—Fleit, Jacobson, Cohn & Price

[57] ABSTRACT

An adjustable cutter apparatus for longitudinally slicing thin sheet materials such as copper foil used in stained glass processing has the coil mounted on a roll from which it is pulled through a guideway across a cutter blade. The guideway is defined between adjustable guide plates the spacing and locating of which can be adjusted relative to the cutter blade to suit different width foils and different widths of cut.

11 Claims, 4 Drawing Figures

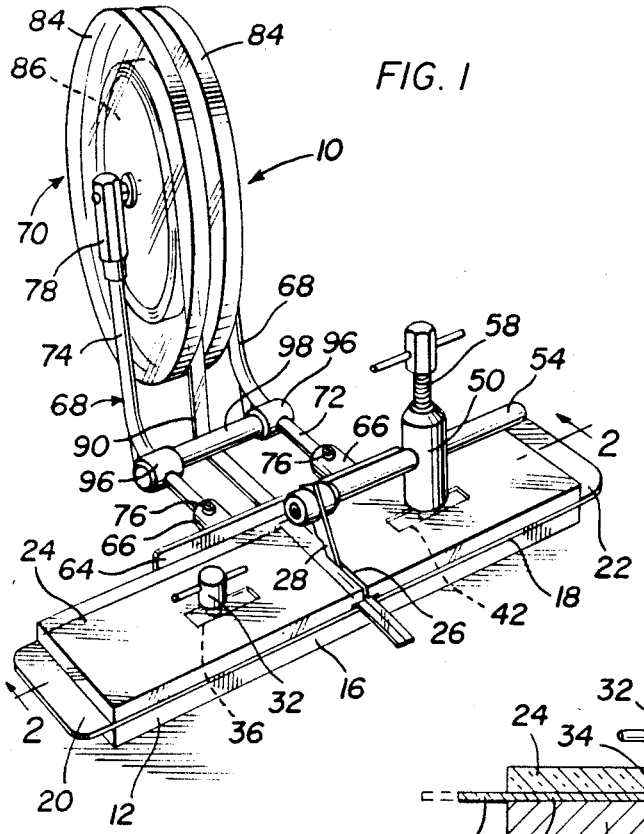
FIG. 1
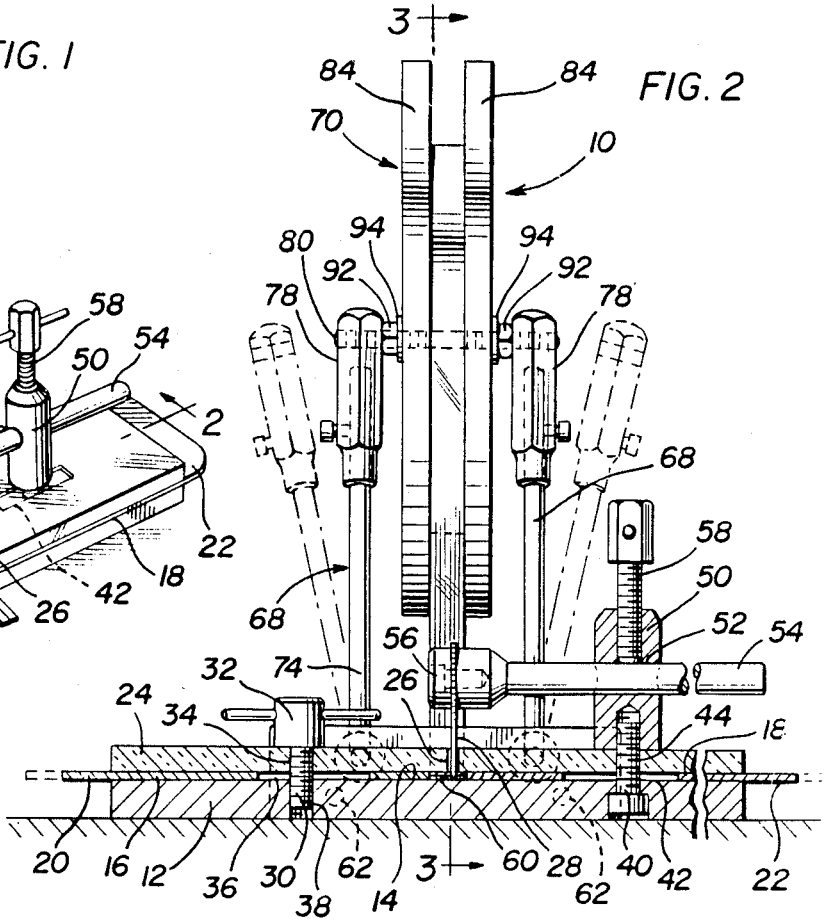
FIG. 2
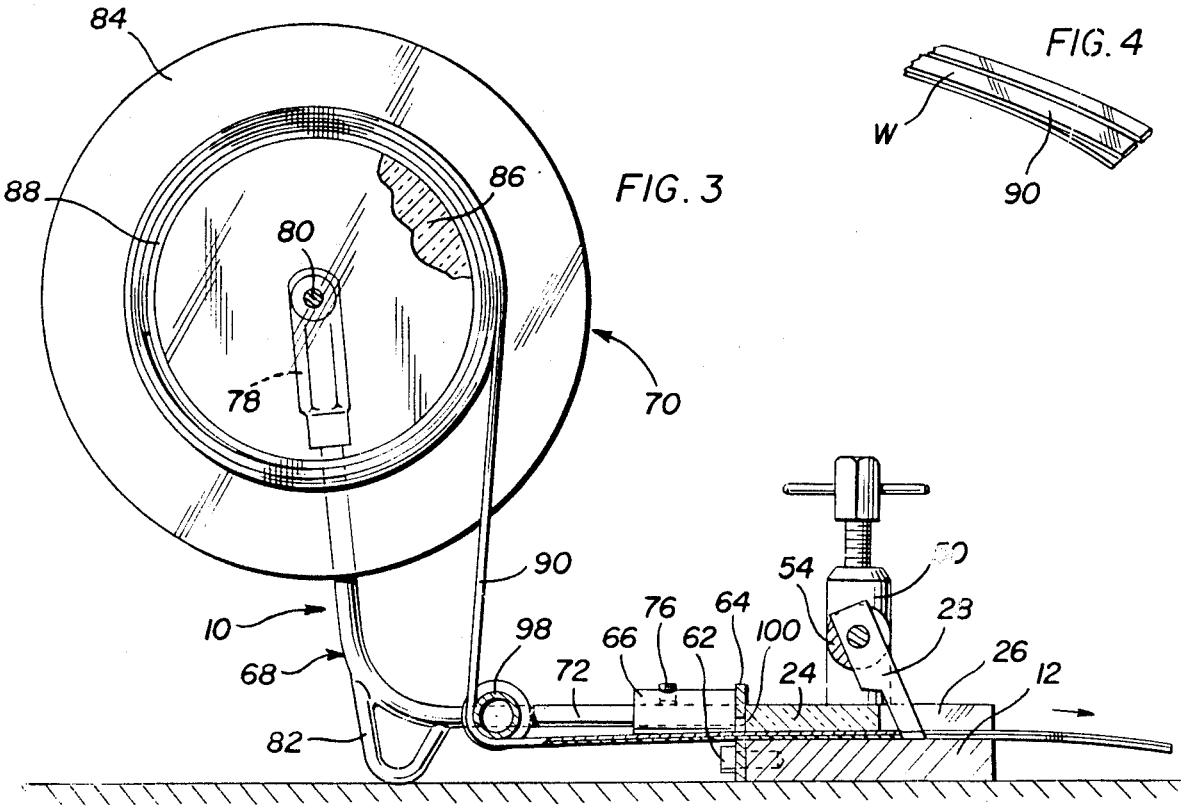
FIG. 3
FIG. 4

COPPER FOIL CUTTER

BACKGROUND AND SUMMARY OF THE INVENTION

This invention relates to an adjustable cutting apparatus for longitudinally slicing lenghts of strip material to a desired width. For example, the tool may be used to slice strips of copper foil used in stained glass processing to a desired width.

In accordance with the invention there is provided an adjustable cutter for longitudinally slicing a length of strip material such as copper foil to a desired width wherein the strip of foil is pulled through a guideway across a cutting blade which longitudinally splits the foil along a required line as it is pulled through the guideway. The apparatus includes a base member with a cutting surface and a see-through blade guide plate over the surface which includes an elongate slit for receiving the cutting blade. A pair of adjustable plates are located between the see-through guide plate and the base member, the plates having respective inner edges which can be adjusted laterally with respect to the slit to define a guideway of a selected width to suit the width of the foil being cut and a selected location relative to the slit dependent on the width to which the foil is to be cut. The cutter may further include support means for a reel of foil in the form of rods having horizontal sections extending from the base member and vertical sections mounting a reel shaft therebetween. The reel shaft can be removed by swiveling the rods about the horizontal sections. Further, the reel shaft may be threaded with a reel mounted thereon between a pair of end plates with nuts outside of the end plates which can be used to adjust the position of the end plates so as to align same with the foil guideway and to adjust the end plates so as to accommodate reels of different width foil. The horizontal sections of the arms may carry a foil roller over which the foil travels to the guideway.

In use, the foil is accurately slit to a desired width longitudinally simply by pulling same through the guideway across the cutting blade which extends into the guideway through the blade slit in the blade guide plate. The see-through nature of the plates allows for accurate positioning of the respective guideplates which define the guideway.

Applicant is aware of the following U.S. patents pertaining to cutting devices and the like: U.S. Pat. Nos. 2,822,046; 4,018,119; 4,175,460; 2,316,249 and 1,747,264.

None of the above patents, however, discloses a cutting device having the features of the present invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a foil cutting apparatus in accordance with the invention.

FIG. 2 is an enlarged sectional view on line 2—2 of FIG. 1.

FIG. 3 is a sectional view on line 3—3 of FIG. 2.

FIG. 4 is a perspective view of a strip of foil slit by the apparatus.

DESCRIPTION OF PREFERRED EMBODIMENT

An adjustable foil cutting device in accordance with the invention in generally indicated by reference 10 in the drawings. The cutting device includes a base plate 12 which may be of mild steel or like relatively heavy material, the base plate having an upper cutting surface 14. Mounted atop the base plate are a pair of laterally adjustable guideplates 16, 18 having projecting outer tabs 20, 22, by means of which the position of the guide plates may be adjusted, as will be described, and a see-through blade guide plate 24 which may be of Perspex or the like is mounted above the adjustable guide plates. The blade guide plate 24 is provided with an elongate central blade slit 26 extending through the plate for receipt of a cutting blade 28. A first hold down thumb screw 30 with an integral head 32 extends through an aperture 34 in plate 24, through a laterally extending slot 36 in plate 16, and into a threaded aperture 38 in the base plate. A second hold down screw 40 extends upwardly from the base plate through a similar laterally extending slot 42 in guide plate 18 and an aperture 44 in guide plate 24. A cap nut 50 is threaded onto the projecting upper end of screw 40. The cap nut 50 has a throughbore 52 for receiving a rod 54 that carries blade 28 at one end, the blade being held releasably in place by an Allen screw 56 or the like. A thumb screw 58 extends into cap nut 50 to releasably retain rod 54 in place. The rod can be adjusted lengthwise in bore 52 so as to position the blade in alignment with slit 26 and the height of the blade is such that it may pass through slit 56 into a guideway space 60 formed between the respective inner edges of guide plates 16 and 18.

It will be understood from the above description that when screw 30 and cap nut 50 are loosened, plates 16 and 18 can be adjusted laterally so that the spacing between their respective inner edges can be adjusted and the location of the respective inner edges relative to slit 26 can also be adjusted. Thus, guideway 60 can be adjusted in width to suit particular widths of foil to be cut and can also be located laterally with respect to slit 26 and blade 28 so as to cut the foil to a desired width.

Secured by screws 62 to one edge of the base plate is a mounting plate 64 for a pair of tubular journal supports 66. The journal supports 66 carry respective support rods 68 for a foil reel assembly 70. The support rods 68 have horizontal sections 72 received in the respective journal supports 66, and vertical sections 74. Allen screws 76 are provided for the journal supports to tighten onto the respective rods. The upper ends of rods 68 have threaded on sleeves 78 which between them carry a threaded shaft 80 that mounts the reel assembly. Welded onto the corners of rods 68 are support feet 82.

The reel assembly 70 includes a pair of large diameter outer discs 84 and a small diameter center disc 86 that carries a reel 88 with a wound-on foil strip 90. The position of the respective discs is set on shaft 80 by means of adjustment nuts 92 whereby the location of the discs may be adjusted along the shaft so as to center the foil 90 with respect to guideway 60. Interposed washers 94 are provided between the nuts 92 and the outer discs 84.

It will be understood that in order to replace the foil, the rods 68 may be pivoted outwardly to the positions shown in dotted line in FIG. 2. Also, to accommodate difficult width foils the discs 84 may be moved accordingly on shaft 80 and the alignment of the foil may also be adjusted relative to slit 26. To accommodate larger or smaller width foils, wider or narrower discs 86 may be used.

Supported on collars 96 on the horizontal sections 72 of rods 68 is a roller 98 under which the foil passes.

It will be understood that the foil 90 is adjusted in position relative to slit 26 and blade 28 by lateral adjustment of guide plates 16 and 18 and reel assembly 70, so that a desired width W of foil (see FIG. 4) may be cut from the foil. The foil on reel assembly 70 is passes around the back of and under roller 98 and through an opening 100 in plate 64 and through the guideway 60. With the knife blade 28 suitably positioned in the guideway, pulling the foil therethrough in the direction shown by the arrow in FIG. 3 thereby effects lengthwise slicing of the foil to the desired width W.

The foregoing is considered as illustrative only of the principles of the invention. Further, since numerous modifications and changes will readily occur to those skilled in the act, it is not desired to limit the invention to the exact construction and operation shown and described, and accordingly, all suitable modifications and equivalents may be resorted to, falling within the scope of the invention.

What is claimed as new is as follows:

1. Apparatus for longitudinally cutting a length of strip material such as copper foil to a desired width comprising a base member having an upper cutting surface, a blade guide plate for positioning on the upper surface of the base member, the blade guide plate including an elongate blade slit formed therethrough, guide means defining an elongate pull-through guideway for the strip material between the base member and guide plate parallel to and below the slit and adjustable as to width and location transversely of the slit, hold down means for releasably clamping together the base member, the guide means, and the blade guide plate, and blade holder means for supporting cutting blade in a position extending into the guideway through the slit to longitudinally cut the material as it is pulled lengthwise through the guideway, said guide means comprising a pair of mutually adjustable guide plates having adjacent edges movable laterally and independently to respective positions defining the guideway therebetween of a width conforming to the width of the material and a location related to the slit dependent on the desired width to which the material is to be cut, said mutually adjustable guide plates having respective outer portions projecting from between the base member and the blade guide plate for adjustably moving the adjustable guide plates upon release of the hold down means.

2. The invention of claim 1 further including support means for rotatably supporting a reel for winding the strip material on in longitudinal alignment with the guideway and for unwinding the strip material from as it is pulled through the guideway.

3. The invention of claim 2 wherein the support means include a roller for guiding the strip material over between the reel and an entrance to the guideway.

4. The invention of claim 2 wherein the support means comprises a pair of rods extending outwardly and upwardly from said base member for supporting a reel shaft therebetween.

5. The invention of claim 4 wherein the rods have lower substantially horizontal portions extending from the base member and upper substantially vertical positions for supporting the reel shaft, and wherein the vertical portions can be opened out laterally for replacement of the reel by axial swiveling of the horizontal portions.

6. The invention of claim 5 wherein the reel shaft is threaded and has a disc supported thereon for mounting the reel, larger diameter end plates on the shaft embracing the disc, and nuts threaded on the shaft outside of the end plates for locating the end plates and reel laterally in alignment with said guideway and for adjusting the distance between the end plates to suit different width discs for different widths of material strips.

7. The invention of claim 1 wherein the hold down means comprises a first hold down screw assembly having a screw extending through a hole in the blade guide plate on one side of said slit, through a slot in one of said adjustable guideplates allowing for lateral adjustment thereof, and into the base member, and a second hold down screw and nut assembly having a further screw extending through a further hole in the blade guide plate on the other side of said slit, through a slot in the other of said adjustable guide plates and into the base member.

8. The invention of claim 7 wherein the second hold down screw is extended above the blade guide plate and is provided with a hold down nut thereon which is formed as part of the holder means for the blade.

9. The invention of claim 8 wherein the nut is formed with a throughbore receiving a rod on which the blade is mounted, the throughbore and rod together defining the holder means, and wherein the nut is further provided with a screw for releasably clamping the rod in the throughbore.

10. Apparatus for longitudinally cutting a length of strip material such as copper foil to a desired width comprising a base member having an upper cutting surface, a blade guide plate for positioning on the upper surface of the base member, the blade guide plate including an elongate blade slit formed therethrough, guide means defining an elongate pull-through guideway for the strip material between the base member and guide plate parallel to and below the slit and adjustable as to width and location transversely of the slit, hold down means for releasably clamping together the base member, the guide means, and the blade guide plate, and blade holder means for supporting a cutting blade in a position extending into the guideway through the slit to longitudinally cut the material as it is pulled lengthwise through the guideway, support means for rotatably supporting a reel for winding the strip material on in longitudinal alignment with the guideway and for unwinding the strip material from as it is pulled through the guideway, said support means comprising a pair of rods extending outwardly and upwardly from said base member for supporting a reel shaft therebetween, said rods having lower substantially horizontal portions extending from the base member and upper substantially vertical portions for supporting the reel shaft, and wherein the vertical portions can be opened out laterally for replacement of the reel by axial swiveling of the horizontal portions, said reel shaft being threaded and having a disc supported thereon for mounting the reel, larger diameter end plates on the shaft embracing the disc, and nuts threaded on the shaft outside of the end plates for locating the end plates and reel laterally in alignment with said guideway and for adjusting the distance between the end plates to suit different width discs for different widths of material strips.

11. A cutter for lengthwise slitting a strip of material by pulling a free end of the strip of material and moving it lengthwise, said cutter comprising a base, means on said base forming a continuous guideway receiving said strip of material, said guideway being dimensioned to closely receive said strip of material and enabling the strip of material to be moved therethrough when tension is applied to a free end portion thereof, means mounted on said base to rotatably support a supply reel of strip material thereon with the strip of material being unwound from said reel as it passes through the guideway, and blade means mounted on said base and extending into said guideway for lengthwise slitting of the strip of material as it passes therethrough, said means forming the guideway includes means to laterally adjust the guideway and strip of material therein laterally in relation to said blade means to vary the lateral position of the blade means in relation to the edges of the strip of material, said support means for the supply reel including means to laterally adjust the supply reel for alignment with the laterally adjustable guideway, said means forming the guideway including a bottom plate forming said base, a top plate having a slit like opening therein receiving said blade means and a pair of intermediate plates spacing the top plate from the bottom plate and having laterally spaced inner edges defining the edges of the guideway with the bottom plate defining the bottom of the guideway and the top plate defining the top of the guideway and means enabling independent inward and outward adjustment of the intermediate plates to enable adjustment of the width of the guideway and lateral adjustment of the guideway in relation to the blade means.

* * * * *